US008544560B2

(12) United States Patent
Bertram et al.

(10) Patent No.: US 8,544,560 B2
(45) Date of Patent: Oct. 1, 2013

(54) DRIVE MECHANISM

(75) Inventors: William Bertram, Cottenham (GB); Walter Aldred, Thriplow (GB); Ashley Johnson, Milton (GB); Frank Espinosa, Sugar Land, TX (US); Michael Barrett, Histon (GB); Carlos Delgado, Trondheim (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 409 days.

(21) Appl. No.: 12/611,191

(22) Filed: Nov. 3, 2009

(65) Prior Publication Data

US 2011/0100640 A1 May 5, 2011

(51) Int. Cl.
*E21B 4/06* (2006.01)

(52) U.S. Cl.
USPC ..... 173/93.7; 175/61; 175/106

(58) Field of Classification Search
USPC ..... 175/61, 75, 92, 101, 104, 106; 173/93.7, 173/90
See application file for complete search history.

(56) References Cited

U.S. PATENT DOCUMENTS

| | | | | |
|---|---|---|---|---|
| 3,593,810 | A * | 7/1971 | Fields | 175/61 |
| 4,286,676 | A * | 9/1981 | Nguyen et al. | 175/74 |
| 4,596,294 | A * | 6/1986 | Russell | 175/74 |
| 4,719,978 | A * | 1/1988 | Klemm | 175/113 |
| 4,884,643 | A * | 12/1989 | Wawrzynowski et al. | 175/74 |
| 5,297,641 | A * | 3/1994 | Falgout, Sr. | 175/73 |
| 5,318,137 | A * | 6/1994 | Johnson et al. | 175/40 |
| 5,318,138 | A * | 6/1994 | Dewey et al. | 175/74 |
| 5,445,230 | A * | 8/1995 | Wattenburg et al. | 175/74 |
| 5,673,765 | A * | 10/1997 | Wattenburg et al. | 175/322 |
| 6,082,453 | A * | 7/2000 | Bakke | 166/240 |
| 6,467,547 | B2 * | 10/2002 | Maguire et al. | 166/386 |
| 6,745,836 | B2 * | 6/2004 | Taylor et al. | 166/301 |
| 7,543,658 | B2 | 6/2009 | Russell et al. | |
| 7,581,460 | B2 * | 9/2009 | Cooper | 74/128 |
| 2002/0070032 | A1 * | 6/2002 | Maguire et al. | 166/381 |
| 2006/0124306 | A1 * | 6/2006 | Vail, III | 166/285 |
| 2009/0044977 | A1 | 2/2009 | Johnson et al. | |
| 2010/0326674 | A1 * | 12/2010 | Nguyen et al. | 166/382 |

FOREIGN PATENT DOCUMENTS

WO 2009117478 9/2009

OTHER PUBLICATIONS

International Search Report of PCT Application Serial No. PCT/IB2010/002619 dated Jun. 14, 2011.

* cited by examiner

*Primary Examiner* — Alexandra Elve
*Assistant Examiner* — Andrew M Tecco

(57) ABSTRACT

A drive mechanism is described for moving/controlling objects/mechanisms/systems coupled with a drillstring and/or pipe. The drive mechanism may be axially arranged on a drillstring or pipe, compact, capable of fine control and delivering high torque or the like and may be electrically and/or hydraulically powered. The drive mechanism may comprising a driving member comprising a plurality of drivers linearly translatable with respect to the driving member, each driving member having at their ends a male engaging portion and an associated driven member, comprising a plurality of female receiving portions adapted to receive a male engaging portion, the arrangement being such that linear translation of a driver causes its engaging portion to engage with a female receiving portion and the action of the engaging portion produces a reaction in the receiving portion causing displacement of the driven member in a direction other than that of the translatable driver.

25 Claims, 6 Drawing Sheets

DRIVE MECHANISM

FIELD

The present invention relates to a drive mechanism and more particularly, but not by way of limitation, to a drive mechanism capable of delivering high torque and that can occupy a small space and may be suitable for use in a downhole environment or on a pipeline.

BACKGROUND

Mechanisms for inducing motion from a driving member, such as a shaft or piston, to a driven member, such as another shaft or axle, are widespread throughout many technical areas.

In an underground environment, such as in an oil or gas wellbore, a variety of technical operations are carried out which involve moving and placing a variety of pieces of equipment in a number of ways. Drive mechanisms for use in such an underground environment would be highly useful. However, this environment presents significant engineering constraints restricting the design of such devices. It is typically the case that a general lack of space restricts the size such devices can take, and the relative difficulty of obtaining power to drive such a mechanism means that only low power devices are practical. Additionally, it is often desirable that the drive mechanism be disposed in the downhole location such that fluids or the like may pass through a section of wellbore proximal to the drive mechanism. Similar constraints may be associated with drive mechanisms for use on pipelines.

If additional constraints are present, such as requiring a high torque and/or requiring fine control, which control may be in the range of few revolutions per minute, then design options become severely restricted. Known mechanisms fail to adequately satisfy all of these requirements. There is therefore a need for an improved drive mechanism, particularly for use in a downhole environment and/or for operation on pipelines.

SUMMARY

In a first aspect of the present invention, a drive mechanism is provided comprising: (a) a driving member comprising a plurality of drivers linearly translatable with respect to the driving member, each driving member having at their ends a male engaging portion; and (b) an associated driven member, comprising a plurality of female receiving portions adapted to receive a male engaging portion, the arrangement being such that linear translation of a driver causes its engaging portion to engage with a female receiving portion and the action of the engaging portion produces a reaction in the receiving portion causing displacement of the driven member in a direction other than that of the translatable driver, and the arrangement being such that, regardless of the relative positioning of the driving member and driven member, a first translatable driver is always positioned to be engagable with a first receiving portion such that the resulting first displacement of the driven member following engagement of the first translatable driver causes a second moveable driver to be positioned to be engagable with a second receiving portion, wherein the resulting displacement of the driven member following disengagement of the first translatable driver and engagement of the second translatable driver is in the same direction as the first displacement.

As provided in the first aspect of the present application, following the engagement of the second driver and the subsequent displacement of the driven member, a fresh first driver is ready to engage (which may be the same or different to the initial first driver) with a female receiving portion and the second driver is disengaged and displacement of the driven member continues as desired.

In some embodiments of the present invention, a drive mechanism is provided that may require low power, provide a high torque, provide fine control, be small in size and can be disposed around a wellbore, pipe, conduit and/or the like to provide for not interrupting the flow of a fluid or the passage of a tool in the wellbore, pipe, conduit and/or the like.

The linearly translatable drivers are may be elongate in structure and may be arranged to be moveable in a direction parallel to their length in a piston-like manner. Such drivers may be powered by a variety of sources. Merely by way of example, the drivers may be powered by hydraulically, electrically and/or the like.

The engaging portion of a driver may take a variety of forms, provided that the form is such that it is engagable with and causes displacement of the driven member. In a typical arrangement, the engaging portion of the driver may comprise a surface inclined with respect to the direction of movement of the driver. The associated female receiving portions may comprise a corresponding inclined surface such that the two surfaces contact each other upon engagement and further movement of the driving member causes the flat surfaces to slide over each other, having the effect of causing the driven member to displace laterally.

The male engaging portion may take other forms, such as comprising a curved or rolling surface. In the embodiment described above, displacement of the driven member may be in a direction substantially perpendicular to that of the movement of the drivers. In other embodiments, the driver and the female receiving portion may be oriented with respect to one another such that the displacement of the driven member may be at an angle relative to the movement and/or the plane of movement of the drivers.

In some embodiments of the present invention, the female engaging portion may comprise a trough or depression in the driven member. In aspects, this may take the form of sloping sides, for example producing a V-shaped or cone-shaped depression. As persons of skill in the art will appreciate, the depressions and/or the engaging portion of the drivers may have a three dimensional form and this three dimensional form may be designed to provider for a desired motion of the driven member when the driver engages the female receiving portion.

In use, in accordance with one embodiment of the present invention, typically, a first male engaging portion and first female receiving portion may be aligned sufficiently to engage, but are not perfectly in alignment. In this way, after initial engagement further movement of the driver causes the receiving portion to displace and align itself with the engaging portion. Subsequently the driver is withdrawn from the first receiving portion. The displacement of the driven member is sufficient that a new second driver is now ready to be driven to engage a second new receiving portion. This second engagement is again not perfectly in alignment so that displacement of the driven member can occur as before.

The above sequence can be repeated as many times as is necessary, in order to provide movement of the driven member.

Additionally, if it is desired to prevent any movement between the driving member and driven member then this may be achieved in an aspect of the present invention by holding the driver in place while engaged in the first receiving portion, thus locking their relative movement.

Likewise, free movement of the driven member can be achieved by holding the driver members to be disengaged so that none of the drivers are engaged.

Although only one driver at a time needs to be engaged to cause the driven member to displace, in some embodiments of the present invention more than one driver at a time is configured to engage a receiving portion. In this way, more torque and/or finer control may be provided.

In one embodiment of the present invention, the driving member may comprise a series of evenly spaced drivers and the driven member may comprise a series of evenly spaced receiving portions. In certain aspects, the spacing of the drivers may be different to the spacing between the receiving portions. In such aspects, the spacing between the drivers may be greater than the spacing between the receiving portions.

In an embodiment of the present invention, the mechanism may be arranged such that, following the first displacement of the driven member a third linearly translatable driver is positioned to be engagable with a third receiving portion such that the resulting displacement of the driven member following engagement of the third translatable driver is in the opposite direction as the first displacement.

Such an embodiment may provide the option of engaging the second driver to continue driving the driven member in the same direction or alternatively to engage the third driver to reverse the direction of movement of the driven member. Thus forwards and backwards control is achieved.

The driving member and driven member may be aligned so that they "mesh" together, although the spacing of the drives and receivers may not be the same. In some embodiments, this may take the form of evenly spaced receiving portions positioned linearly along a length of the driven member. In other embodiments of the present invention, the receiving portions may be positioned around a circular/cylindrical region of the driven member. It may thus be seen that linearly spaced receiving portions would result in linear displacement of the driven member, whereas circularly spaced receiving portions would result in rotational displacement of the driven member.

When the receiving portions are positioned along a circular region/around a cylindrical region of the driven member, the driven member may resemble a gear cog having a circular or cylindrical geometry with the receiving portions facing outwardly or inwardly. However, some embodiments of the present invention, the driven member may have a cylindrical geometry with the receiving portions facing axially to receive drivers translatable in an axial direction with respect to the cylindrical geometry. In these types of embodiments, the circular spacing of the drivers may be of the same diameter as that of the receiving portions to provide for full interaction between the drivers and the receiving portions.

In the some embodiments of the present invention, the entire drive mechanism may take the form of an annular cylinder, which may be advantageous if the drive mechanism is used downhole or in conjunction with pipeline. A variety of apparatus and equipment and/or fluids may be required to pass the drive when in operation or at rest, and the ability for the drive mechanism to be shaped as an annular cylinder allows for the equipment and/or the fluid to pass through a center/central portion of the cylindrically arranged drive mechanism.

In such cylindrical-type embodiments, the entire drive mechanism can have a length of from less than 500 mm, preferably, 100 to 300 mm and a diameter of less than 200 mm, preferably from 50 to 100 mm, with an annular space at least 20 mm in diameter.

When circularly spaced, the number of receiving portions determines the resolution of rotation of the driven member. However, to have a resolution of, say 10°, does not require 36 receiving portions to each contribute to a full circle of 360°. In view of the fact that a displacement during one engagement tends to be much less than that between two receiving portions, merely by way of example, a resolution of 10° (degrees) may be achieved with ten (10) or so receiving portions. In certain aspects, a higher number of receiving portions will provide a corresponding increase in resolution.

Merely by way of example, when the receiving portions are arranged in a circle, a drive mechanism having between 5 and 30 receiving portions may provide an accurately controllable drive mechanism.

In view of the above features and advantages, the mechanism of the present invention is suited for use in underground/downhole operations and operations along pipelines. Thus, the mechanism may be associated and/or used with apparatus/systems designed for use in a drilled underground installation or along a pipeline.

As discussed above, the drive mechanism according to the present invention may take the form of an annular cylinder. This feature is particularly advantageous during drilling operations where a central shaft and possibly other equipment must be allowed to pass. Thus, the drive mechanism in an embodiment of the present invention may be comprise annular cylindrical form and may be a component in a drillstring.

For example, during directional drilling operations it is common for the drillstring to comprise an angled bend in the bottomhole assembly. Power for drilling is provided by a mud motor. The drill bit is positioned at an angle to the rest of the drillstring and may be coupled to the motor by a hinge-type or tilted mechanism/joint, a bent sub or the like wherein the drill bit is at an angle to the motor.

In this arrangement, the direction of drilling is governed by the direction the drill bit is pointed in. Clearly it is desirable to be able to steer the drill by rotating the drillstring to orient the drill bit to the desired direction. However, this presents a significant difficulty.

When drilling for oil and/or gas it is not uncommon to drill at lengths of several kilometers. With such lengths of tubing a rotation applied at the surface may take a significant amount of time to be transmitted to the drill bit due to the elasticity of the metallic drillstring. This delay in transmission of rotation can make it difficult or impossible to effectively steer a drill bit in response to positional measurements transmitted to the surface.

Moreover, for some types of drilling methods, e.g. when so-called "coiled tubing" is employed, the tubing may not be capable of being rotated at the surface such that the drill bit can be pointed by such rotation. As such, with coiled tubing drilling and with conventional drilling where the drill bit is located a long distance from the drill rig, a so-called "orienter" may be used, where the orienter is positioned on the drillstring and acts to rotate the drillstring according to directional drilling requirements.

Conventional orienters may be of a fairly large size because of the orientation mechanism used and/or in order to develop the torque necessary to rotate the drillstring. Moreover, when used in combination with a downhole motor, which motor may be used to drive the drill bit and/or the like, because of space limitations, conventional orienters have to be/are located above the downhole motor. Locating the orienter above the downhole motor means that the orienter may be designed to be powered to the order of several kilowatts, which power must be provided to the orienter in some manner, as the orienter must move the downhole motor/overcome the torque of the downhole motor.

In embodiments of the present invention, the drive mechanism of the present invention may be effective in a drilling system configuration using a downhole motor because of the size of the drive system and/or the torque that may be generated by the drive mechanism.

In embodiments of the present invention where the drive mechanism can take up a small space, the drive mechanism may be located between the downhole motor and the drill bit. In this location the drive mechanism of an embodiment of the present invention may provide for providing effective orientation of the drillstring/bottomhole assembly using powers of a few hundred watts or less. Furthermore, this arrangement of the drive mechanism in accordance with an embodiment of the present invention may obviate the need for an angled bend in the bottomhole assembly to provide for the directional drilling as the drive mechanism may steer only the portion of the drillstring in the vicinity of the drill bit.

In embodiments of the present invention, the drive mechanism may be located less than 500 m, preferably less than 200 m, more preferably less than 50 m, even more preferably less than 20 m away from the cutting surface of the drill bit.

In some directional drilling apparatus the inclination of the angled bend is variable. This may, for example, be adjustable by moving a sleeve over the region where the angled bend begins. As the sleeve is pushed over the bend the angle reduces as the sleeve straightens the bend. The mechanism according to the present invention in its annular cylinder form is suited for applying movement to such a sleeve to control its position.

BRIEF DESCRIPTION OF THE DRAWINGS

The invention will now be illustrated, by way of non-limiting examples, and with reference to the following figures, in which.

Figure 1:
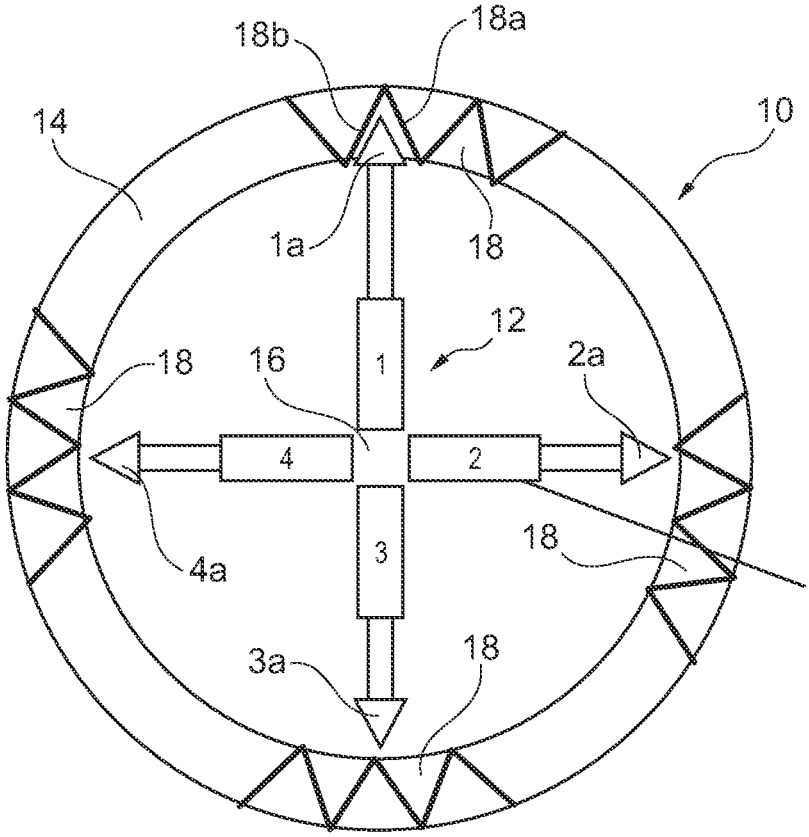
FIG. 1 is a schematic representation of a cross-sectional view of a mechanism according to one embodiment of the present invention.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention. It being understood that various changes may be made in the function and arrangement of elements without departing from the scope of the invention as set forth in the appended claims.

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

FIG. 1 is a schematic representation of a cross-sectional view of a mechanism according to one embodiment of the present invention. As illustrated in FIG. 1, a drive mechanism 10 comprises a driving member 12 and a driven member 14. Driving member 12 comprises four hydraulic actuators 1, 2, 3, 4, being drivers, mounted on a central hub 16. Of course other numbers of actuators, including odd numbers of actuators, may be used in different embodiments of the present invention. At the ends of hydraulic actuators 1, 2, 3, 4 are engaging portions 1*a*, 2*a*, 3*a* and 4*a*, which as depicted are triangular in cross-section and each having two flat faces inclined to the direction of movement of the actuators. Again, the number of actuators and the shape of the engaging positions have been selected, among other things, for clarity and are merely examples of one embodiment of the present invention and different shapes of the engaging positions, including non-linear shapes, and different numbers of actuators may be used in other embodiments of the present invention.

The driven member 14 comprises a plurality of receiving portions 18 being triangular in cross-section and presenting two flat faces each, receiving faces 18*a* and 18*b* in the figure. As with the engaging positions, the shape of the receiving portion is merely an example of one embodiment of the present invention and other shapes, including non-linear shapes, may be used in other embodiments. Furthermore, the description of the receiving portions 18 as comprising two flat faces is merely an example of one embodiment of the present invention and in other embodiments the receiving portions 18 may comprise one or more receiving faces and different receiving portions 18 may comprise different shapes and/or different numbers/configurations of receiving faces. Similarly, the engaging portions 1*a*, 2*a*, 3*a* and 4*a* may comprise different shapes/configurations to one another.

In the depicted embodiment of the present invention, the receiving portions 18 are configured relative to the engaging portions 1*a*, 2*a*, 3*a* and 4*a* so that a flat face of a receiving portion 18 engages a flat face of an engaging portion 1*a*, 2*a*, 3*a*, 4*a*.

As depicted in FIG. 1, the actuator 1 is engaged with a respective one of the receiving portions 18. The engagement of the actuator 1 with the respective one of the receiving portions 18 causes the driven member 14 to rotate so that respective one of the receiving portions 18 is aligned with the engaging portion, i.e., with the depicted configuration the engaging portion 1*a* moves to a center of the respective one of the receiving portions 18.

In an embodiment of the present invention, the actuator 1 may be withdrawn from the respective one of the receiving portions 18 and two options. The actuator 4 may engage its respective one of the receiving portions 18, which as depicted in FIG. 1 is misaligned with its respective one of the receiving portions 18 as a result of the rotation of the driven member 14 in response to the engagement with the actuator 1. Upon engagement of the actuator 4 and the driven member 14, the flat face of the engaging portion 4*a* and the respective one of the receiving portions 18 meet/interact. Further movement of the actuator 4 causes the faces to slide over each other thus causing the driven member 14 to rotate and the respective one of the receiving portions 18 to align itself to the engaging portion 4*a*. Actuator 4 may then be withdrawn and actuator 2 extended to continue the rotational movement of the driven member 14, which in this depicted embodiment of the present invention is a clockwise rotational motion of the driven member 14.

In an alternative operation of the drive mechanism in accordance with an embodiment of the present invention, the actuator 2 may be used to engage the driven member 14 instead of the actuator 4. This configuration/mode of operation will have the effect of driven member 14 being displacing by the actuator 2 in an anti-clockwise direction, and thus reversing the direction of movement. This operation of the drive mechanism 10 may be followed by the actuator 3 being a used to engage with the driven member 14 to continue the anti-clockwise movement of the drive mechanism 10.

In some embodiments, a pre-prepared set of sequences of activating actuators 1, 2, 3, 4 may be installed in electronic form so that high-level commands can be issued and automatic control executes those commands by use of the pre-prepared sequences. In certain aspects, a controller, such as a processor or the like, may control the actuators to provide the desired rotation of the drive mechanism.

Figure 2:
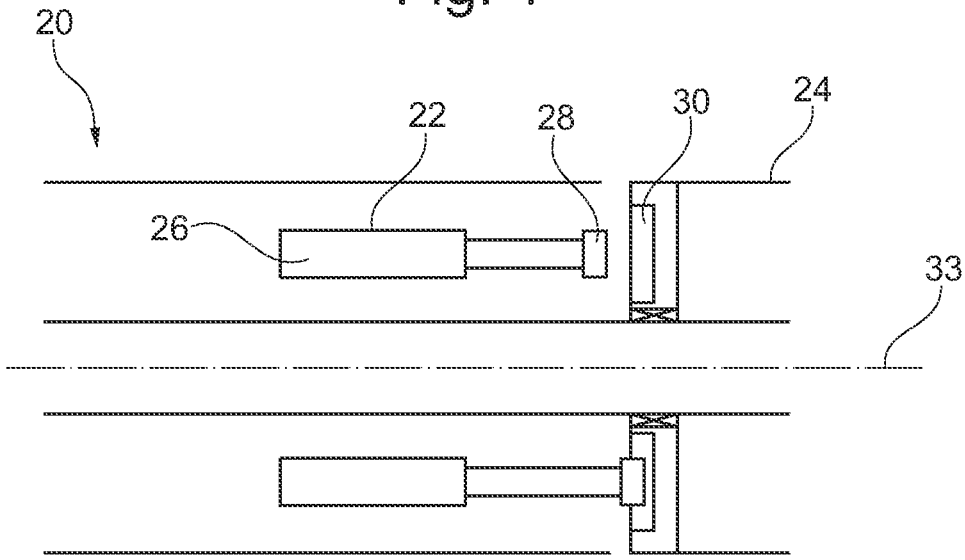
FIG. 2 is a schematic representation of a side view of a further mechanism according to one embodiment of the present invention.

FIG. 2 shows a side view of a drive mechanism 20 configured in a cylindrical form, according to an embodiment of the present invention. The drive mechanism 20 comprises driving member 22 and driven member 24. The driving member 22 comprises an actuator 26 with an engaging portion 28. In an embodiment of the present invention, the drive mechanism 20 comprises a plurality of the driving members 22 and the driven members 24 and the driving members 22 and the driven members 24 may be arranged axially/in a circular-type of arrangement around a center line 33 (which may be considered as a center axis).

As depicted, in an embodiment of the present invention, the driven member 24 comprises one or more receiving portions 30. In operation, the actuator 26 is activated and may extend axially/parallel to the center line 33 and the engaging portion 28 may engage with the receiving portion 30. In an embodiment of the present invention, the engaging portion 28 and/or the receiving portion 30 may have active faces that are shaped to interact such that the interaction causes/induces rotational displacement of the driven member 24.

In an embodiment of the present invention, the drive mechanism 20 may have actuator and/or driven components arranged axially around a central axis such that when arranged in a wellbore and/or with a pipeline tools, fluids and/or the like may pass through the drive mechanism 20.

Figure 3:
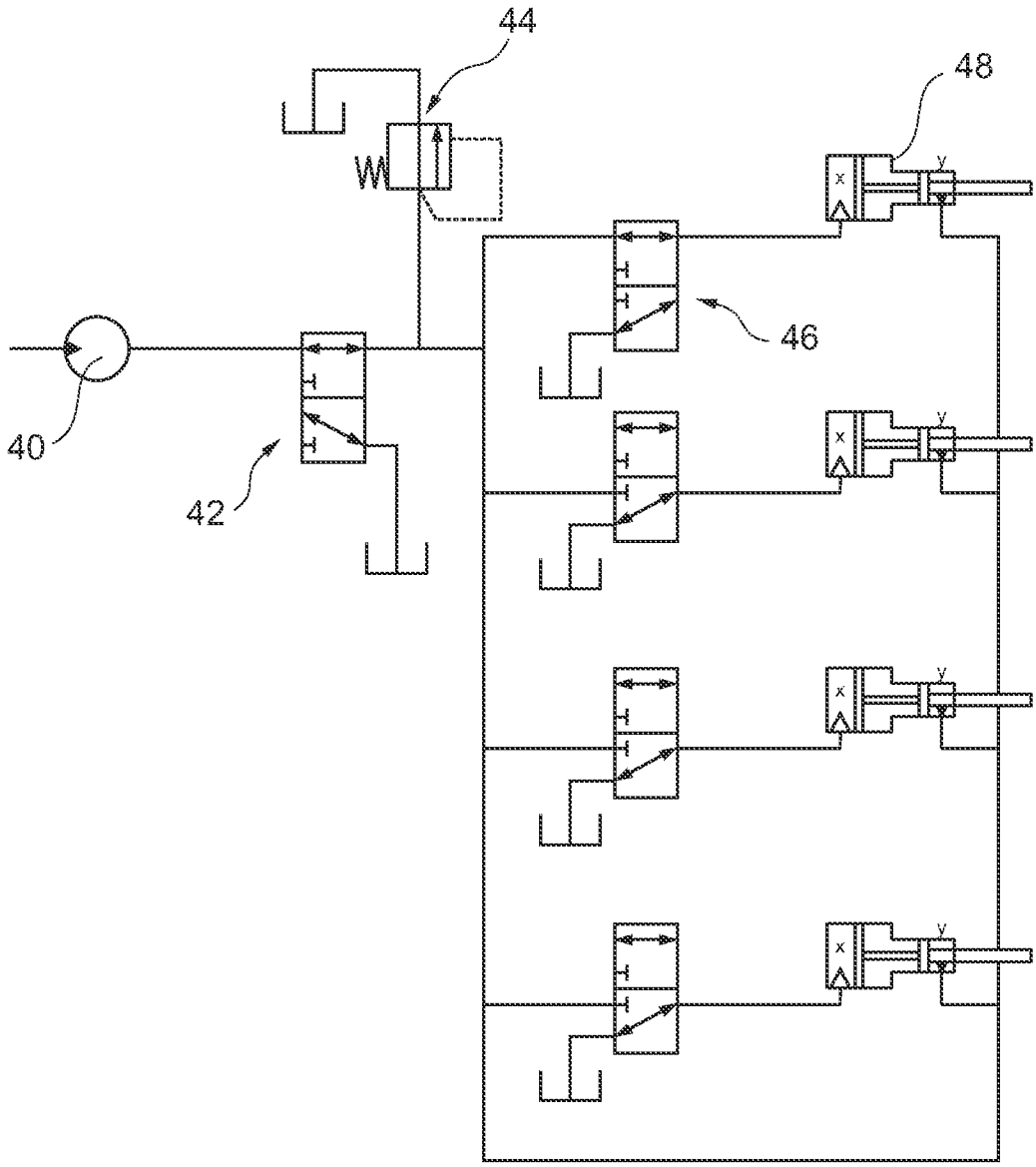
FIG. 3 is a circuit diagram for a hydraulically powered mechanism according to one embodiment of the present invention.

FIG. 3 shows a hydraulic circuit diagram of a driving member according to an embodiment of the present invention. Shown in FIG. 3 is a hydraulic pump 40, a system valve 42, a pressure relief valve 44 and an actuator valve 46 leading to a corresponding actuator 48. In different aspects of the present invention different configurations and different components may be used.

In one aspect of the present invention, the pump 40 may be driven off a drilling motor shaft, driven by an electric motor, driven hydraulically by drilling fluids and/or the like. In one embodiment, the pump 40 may comprise a swash plate pump driven off the drive shaft of a drilling motor where the geometry of the drive mechanism and the drive shaft are suited to an annular installation In an aspect of the present invention, when the valve 40 is activated a hydraulic flow may be directed to the system and surplus fluid, such as oil or the like, may be vented through the relief valve 44. When the system is static, flow from the pump 40 may be vents back to a tank (not shown) through the system valve 42. This arrangement/operation may help to mitigate heating of the hydraulic fluid. In this condition/configuration/mode of operation, pressure is locked in the remainder of the system so the actuator condition prior to closing the system valve 42 is held.

In one embodiment, dual piston (size) actuators may be used and the actuators may be forced back from an engaging position by hydraulic pressure when deactivated. Alternatively, a spring system or the like may be coupled with the actuators to provide for disengagement after the actuator has been engaged with the driven element.

Figure 4:
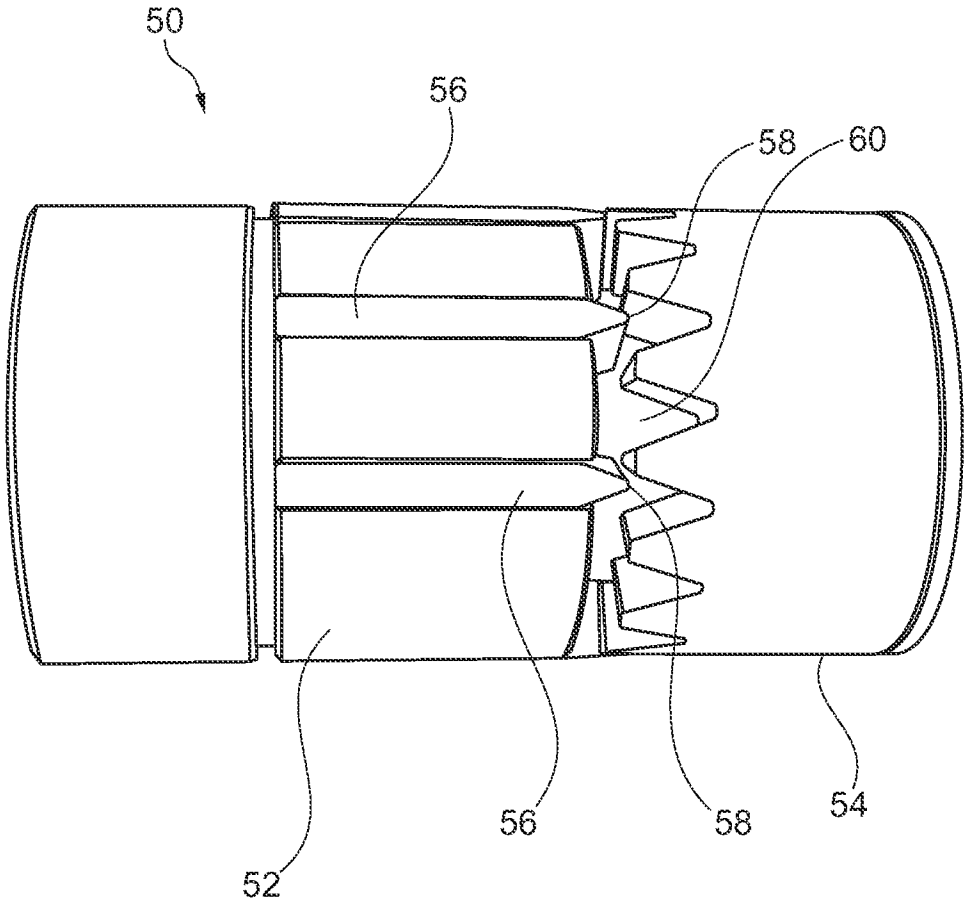
FIG. 4 is an image of a drive mechanism according to one embodiment of the present invention.

FIG. 4 shows an image of a drive mechanism 50, according to an embodiment of the present invention. The drive mechanism 50 comprises a driving member 52 and a driven member 54. The drive mechanism 50 is an annular cylinder or the like and may, merely by way of example, be suitable for forming part of a drillstring for drilling an underground installation/wellbore.

The driving member 52 may comprise a plurality of drivers 56 that may be circularly/axially spaced/arranged. The plurality of drivers 56 may comprise an elongate shape and may have at their ends a male engaging portion 58. The drivers 56 may be configured to be translatable in an axial direction. In one aspect, the male engaging portion 58 may comprise two flat surfaces to form a tapered tip. In other aspects the male engaging portion 58 may comprise a cone shape, a parabolic shape and/or the like and the male engaging portion 58 may comprise one or more bearings for engaging with a surface of the driven member 54.

The driven member 54 may comprises a plurality of receiving portions 60 adapted to cooperate with the plurality of engaging portions 58. In one aspect of the present invention, the plurality of engaging portions 58 may comprise V-shaped recesses with sides at the same angle as the taper on the engaging portions. In other aspects of the present invention, the plurality of engaging portions 58 may comprise parabolic sides, cone shapes and/or the like. In an embodiment of the present invention, the driven member 54 may be free to rotate axially. The driven member 54 may be coupled with a device/system, such as a valve, vibration stochastic motion controller, directional drilling component and/or the like that may be moved in response to the motion of the driven member 54. In an embodiment of the present invention, one of the plurality of engaging portions 58 may be positioned such that it is in a position to be engagable with one of the plurality of receiving portions 60.

In use, in an aspect of the present invention, the drivers 56 may be powered to translate axially according to pre-programmed sequences. In an embodiment of the present invention, a first one of the drivers 56 may be translated axially and may engage with one of the plurality of receiving portion 60. Due to the translation of the one of the drivers 56, one side of a tapered face of the one of the drivers 56 may engage a face of one of the plurality of receiving portions 60. The faces of the drivers 56 and/or the receiving portion 60 may not be symmetrical and in some aspects the differences in the taper or the like of the faces may provide different rotation properties of the driven member 54 in the clockwise versus the anti-clockwise direction. Further movement of the driver 56, after initial engagement with the face of one of plurality of receiving portions 60 resulting from further axial translation of the driver 56 may the causes the face of the driver 56 to slide over the face of the one of plurality of engaging portions 58 causing the driven member 54 to rotate to accommodate the engaging portion 58.

In an embodiment of the present invention, the driver 56 may be withdrawn after engaging and a second of the drivers 56 may be translated to engage a second of the plurality of receiving portions 60 to cause further rotation of the driven member 54 in the same manner. In aspects of the present invention, the driver 56 may not be fully axially translated and may only partially engage with the one of the plurality of receiving portions 60, the amount of engagement and the speed of motion of the driver 56 being chosen/controlled according to the desired amount/speed of rotation of the driven member 54 and/or torque desired. In this way, a portion of the drillstring coupled with the drive mechanism 50 may be rotated in accordance with an embodiment of the present invention. In aspects of the present invention, fine control of the rotation of the driven member 54 may be produced by control of the drivers 56, the geometry of the faces of the drivers/receiving portions, the amount of or location of the drivers/receiving portions and/or the like. Moreover, embodiments of the present invention may provide a drive mechanism capable of delivering a high torque, that be small and only require a small space on a drillstring/pipeline, that may operate using low power and/or the like.

Figure 5A:
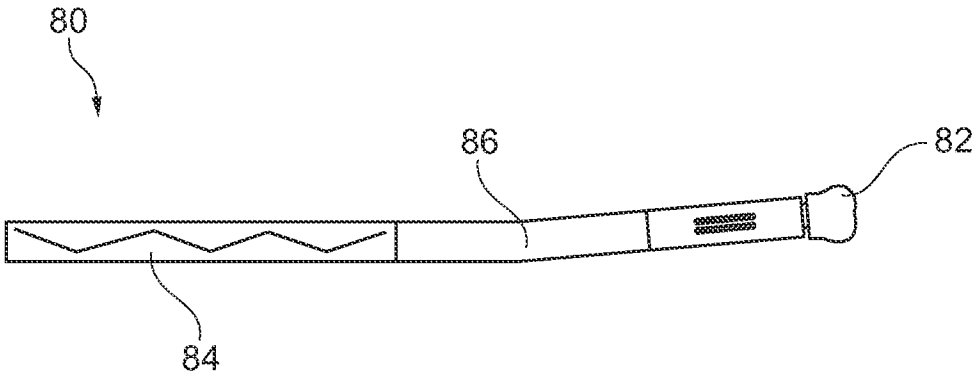
FIGS. 5*a* and 5*b* are schematic representations of the bottomhole apparatus of a drillstring that may be used in combination with an embodiment of the present invention.
Figure 5B:
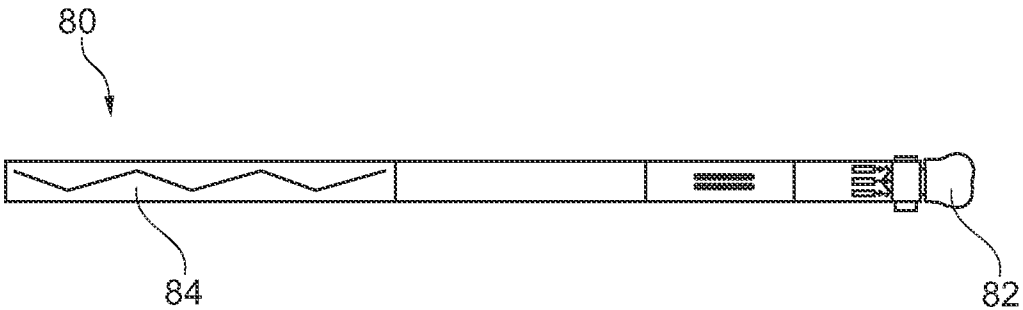

FIGS. 5(*a*) and 5(*b*) show schematic representations of a bottomhole apparatus that may be used for directional drilling connected to a drillstring (not shown) that may be combined with a drive mechanism in accordance with the present invention. As illustrated in FIGS. 5(*a*) and 5(*b*), a drill bit 82 is disposed at the end of a bottomhole assembly 80. The drill bit is powered by power section 84, which, merely by way of example may comprise a monomotor, a mud motor, an electric motor and/or the like.

FIG. 5(*a*) illustrates the bottomhole assembly 80 comprising an angled bend 86. The angled bend 86 may have an angle of inclination and, merely by of example the angle of inclination may be of the order of 1-10 degrees and may in some examples be approximately 1 degree. The drive mechanism of the present invention (not shown) may be employed to rotate the bottomhole assembly 80 and/or the angled bend 86. In an embodiment of the present invention, the drive mechanism may be located below/downhole of the power section 84, i.e. between the power section 84 and the drill bit 82. In this way, in accordance with an embodiment of the present invention, the angled bend 86 may be rotated in the wellbore without the need to rotate the power section 84 and/or other portions of the bottomhole assembly 80 and/or the drillstring. Because the power section 84 may need to generate torque to power the drill bit 82 or the like, it may be difficult/require a lot of power to rotate the power section 84.

FIG. 5(*b*) illustrates bottomhole assembly 80 comprising the power section 84, the drill bit 82, the drive mechanism 89 in a straight housing. The drive mechanism 89 of an embodiment of the present invention, as in the previous FIG. 5(*a*) may be located between the power section 84 and the drill bit 82 or above the power section 84. The drive mechanism 89 may be used to position a directional drilling assembly/system on the drillstring in the wellbore being drilled.

Figure 6:
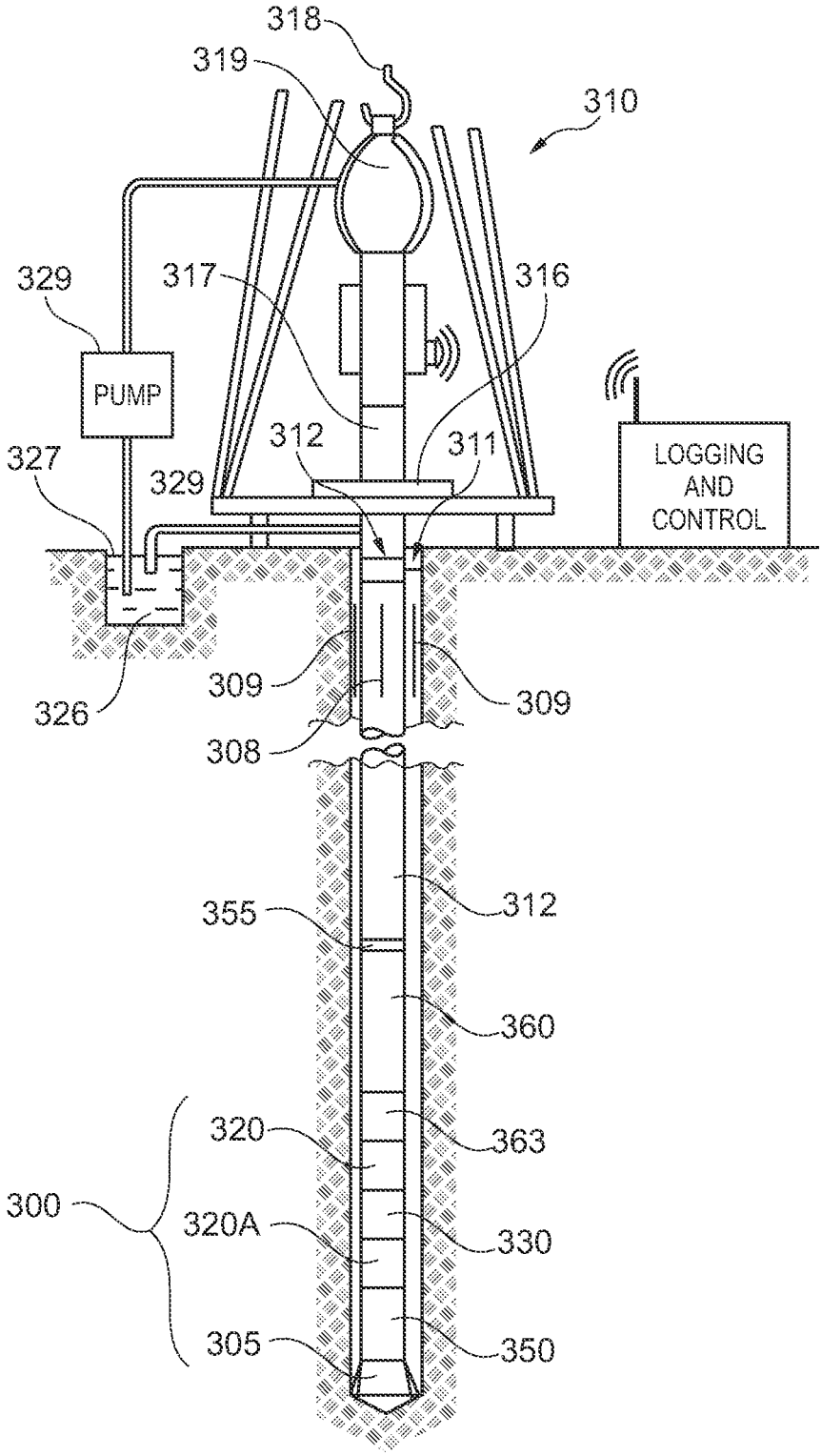
FIG. 6 is a schematic representation of an underground drilling operation in accordance with an embodiment of the present invention.

FIG. 6 illustrates a wellsite system including an orienter, in accordance with an embodiment of the present invention. The wellsite can be located onshore or offshore. In this exemplary system, a borehole 311 is formed in subsurface formations by rotary drilling in a manner that is well known. Embodiments of the invention can also use be used in directional drilling systems, pilot hole drilling systems, cased drilling systems, coiled tubing drilling systems and/or the like.

A drillstring 312 is suspended within the borehole 311 and has a bottomhole assembly 300, which includes a drill bit 305 at its lower end. In an embodiment of the invention, the drillstring 312 may comprise coiled tubing. The surface system includes a platform and derrick assembly 310 positioned over the borehole 311, the assembly 310 including a rotary table 316, kelly 317, hook 318 and rotary swivel 319. The drillstring 312 is rotated by the rotary table 316, energized by means not shown, which engages the kelly 317 at the upper end of the drillstring. The drillstring 312 is suspended from a hook 318, attached to a traveling block (also not shown), through the kelly 317 and the rotary swivel 319 which permits rotation of the drillstring relative to the hook. As is well known, a top drive system could alternatively be used.

In the example of this embodiment, the surface system further includes drilling fluid or mud 326 stored in a pit 327 formed at the well site. A pump 329 delivers the drilling fluid 326 to the interior of the drillstring 312 via a port in the swivel 319, causing the drilling fluid to flow downwardly through the drillstring 312 as indicated by the directional arrow 308. The drilling fluid exits the drillstring 312 via ports in the drill bit 305, and then circulates upwardly through the annulus region between the outside of the drillstring and the wall of the borehole, as indicated by the directional arrows 309. In this well known manner, the drilling fluid lubricates the drill bit 305 and carries formation cuttings up to the surface as it is returned to the pit 327 for recirculation.

The bottomhole assembly 300 of the illustrated embodiment may include a logging-while-drilling (LWD) module 320, a measuring-while-drilling (MWD) module 330, a rotary-steerable system and motor, and drill bit 305.

The LWD module 320 may housed in a special type of drill collar, as is known in the art, and can contain one or a plurality of known types of logging tools. It will also be understood that more than one LWD and/or MWD module can be employed, e.g. as represented at 320A. The LWD module may include capabilities for measuring, processing, and storing information, as well as for communicating with the surface equipment. In one embodiment, the LWD module may include a fluid sampling device.

The MWD module 330 may also housed in a special type of drill collar, as is known in the art, and can contain one or more devices for measuring characteristics of the drillstring and drill bit. The MWD tool may further includes an apparatus (not shown) for generating electrical power to the downhole system. This may typically include a mud turbine generator powered by the flow of the drilling fluid, it being understood that other power and/or battery systems may be employed. In one embodiment, the MWD module may includes one or more of the following types of measuring devices: a weight-on-bit measuring device, a torque measuring device, a vibration measuring device, a shock measuring device, a stick slip measuring device, a direction measuring device, and an inclination measuring device.

In an embodiment of the present invention, an orienter 360, as described in more detail herein, may be coupled with the drillstring 312, the bottomhole assembly 300 and/or the like.

In the case where coiled tubing is employed, it is not generally possible to rotate the drillstring 312 as described above. Instead a downhole motor 355, such as a mud motor, electric motor and/or the like may be provided as part of the drillstring (coiled tubing system) to provide power to rotate the drill bit 305. Even in conventional drilling operations or casing drilling operations, the downhole motor 355 may be used to provide power to the drill bit 305/bottomhole assembly 300.

In order to change the direction of drilling, an orienter 360 may be positioned above the downhole motor 355 (this configuration is not shown in FIG. 6) to orient the direction of drilling of the drilling system; the orienter being positioned above the motor because known orienters are too large to position below the motor. By contrast, the drive mechanism of an embodiment of the present invention may be coupled with the drillstring, coiled tubing and/or the bottomhole assembly 300 below the downhole motor 355 as the drive mechanism of the present invention may be compact in design and may be coupled axially around the drillstring, coiled tubing and/or bottomhole assembly.

In one embodiment of the present invention, the orienter 360 may be coupled with a directional drilling device 363 and may be used to move the directional drilling device in the borehole 311. In some aspects of the present invention, the directional drilling device may comprise a bent sub and the orienter 360 may rotate the bent sub such that the drill bit 305 is directed by the bent sub to drill in a certain direction.

In other aspects of the present invention, the directional drilling device 363 may comprise a stochastic/dynamic motion controller. Directional drilling using a stochastic/dynamic motion controller is described in United States Patent Publication No. 2009/0044977, the entire disclosure of which is incorporated herein for all purposes. In essence, the stochastic/dynamic motion controller biases the stochastic motion of the drillstring 312/bottomhole assembly 300 in a desired direction; the drillstring 312/bottomhole assembly 300 undergo random/stochastic motion during the drilling process where the random/stochastic motion generally incorporates an average motion of the drillstring 312/bottomhole assembly 300 in all radial directions. The stochastic/dynamic motion controller biases the cutting of the drill bit 305 and/or the interactions of the drillstring 312/bottomhole assembly 300 with an inner-wall of the borehole 311 under the random/stochastic motion so that the random/stochastic motion is harnessed to produce drilling in a particular direction.

Merely by way of example, the stochastic/dynamic motion controller may comprise a cylinder eccentrically coupled to the drillstring 312/bottomhole assembly 300, a cylinder or set of gauge pads with non-uniform circumferential compliance coupled to the drillstring 312/bottomhole assembly 300, a set of gauge cutters with different lengths coupled with the drillstring 312/bottomhole assembly 300, a cylinder or the like with an eccentric weight distribution coupled to the drillstring 312/bottomhole assembly 300 and/or the like. By holding the stochastic/dynamic motion controller geostationary in the borehole 311, the stochastic/dynamic motion controller repeatedly biases the random/stochastic motion in the same direction producing directional drilling.

In an embodiment of the present invention, the orienter 360 may be used to move the stochastic/dynamic motion controller in the borehole and so select the direction of the directional drilling. Moreover, in an embodiment of the present invention, a driver of the orienter 360, as discussed above, may be held in an engaged position with the driven member so locking the orienter 360. In such an embodiment, if the orienter 360 is isolated from any rotation of the drillstring 312/bottomhole assembly 300 and/or held geostationary in the borehole 311, the orienter 360 will hold the stochastic/dynamic motion controller geostationary in the borehole 311.

In an embodiment of the present invention, there is a synergistic relationship between the orienter 360 and the stochastic/dynamic motion controller in that the orienter 360 and the stochastic/dynamic motion controller may be configured to be compact, may have few moving parts, may be arranged so that the whole system may be configured axially around the drillstring 312/bottomhole assembly 300 allowing tools and fluids to flow with little or no impedance through the drillstring 312/bottomhole assembly 300. In an embodiment of the present invention, the orienter 360 and the stochastic/dynamic motion controller, because of the possible compact configuration, may be disposed between the drill bit 305 and the downhole motor 355. Such an embodiment, may allow for an efficient directional drilling system since, among other things, only a small amount of power is need to operate the orienter 360 to position the stochastic/dynamic motion controller as only the stochastic/dynamic motion controller, not the downhole motor 355 needs to be moved by the orienter 360.

In coiled tubing drilling, a downhole motor is used to power the drill bit to drill the borehole. In an embodiment of the present invention, the orienter 30 may be used with the stochastic/dynamic motion controller to provide a directional drilling system for the coiled tubing drilling system. Moreover, by placing the orienter 360 and the stochastic/dynamic motion controller between the downhole motor and the drill bit the directional drilling system may be compact, efficient and/or capable of good directional control.

In an embodiment of the present invention the orienter 360 may be powered by a motor not shown. In aspects of the present invention, the motor to power the orienter 360 may comprise the downhole motor 355, an electric motor, a hydraulic motor and/or the like. In certain aspects, where the motor to power the orienter 360 comprises a hydraulic motor the hydraulic motor may generate some or all of its power from the drilling fluids circulating in the borehole 311, the drill drillstring 312 and/or the bottomhole assembly 300. For example, circulating drilling fluids may be directed so as to cause a longitudinal motion of a driver of the orienter 360. In an embodiment of the present invention, a processor (not shown) may control the orienter 360, the motor to power the orienter, the stochastic/dynamic motion controller and/or the like. The processor may be coupled with sensors, such as gravitational sensors, motion sensors, direction sensors, fluid sensors, rock sensors, microseismic sensor systems, resistivity sensors and/or the like to determine in real-time how to set the orienter 360 to provide for drilling in a desired direction.

Figure 7:
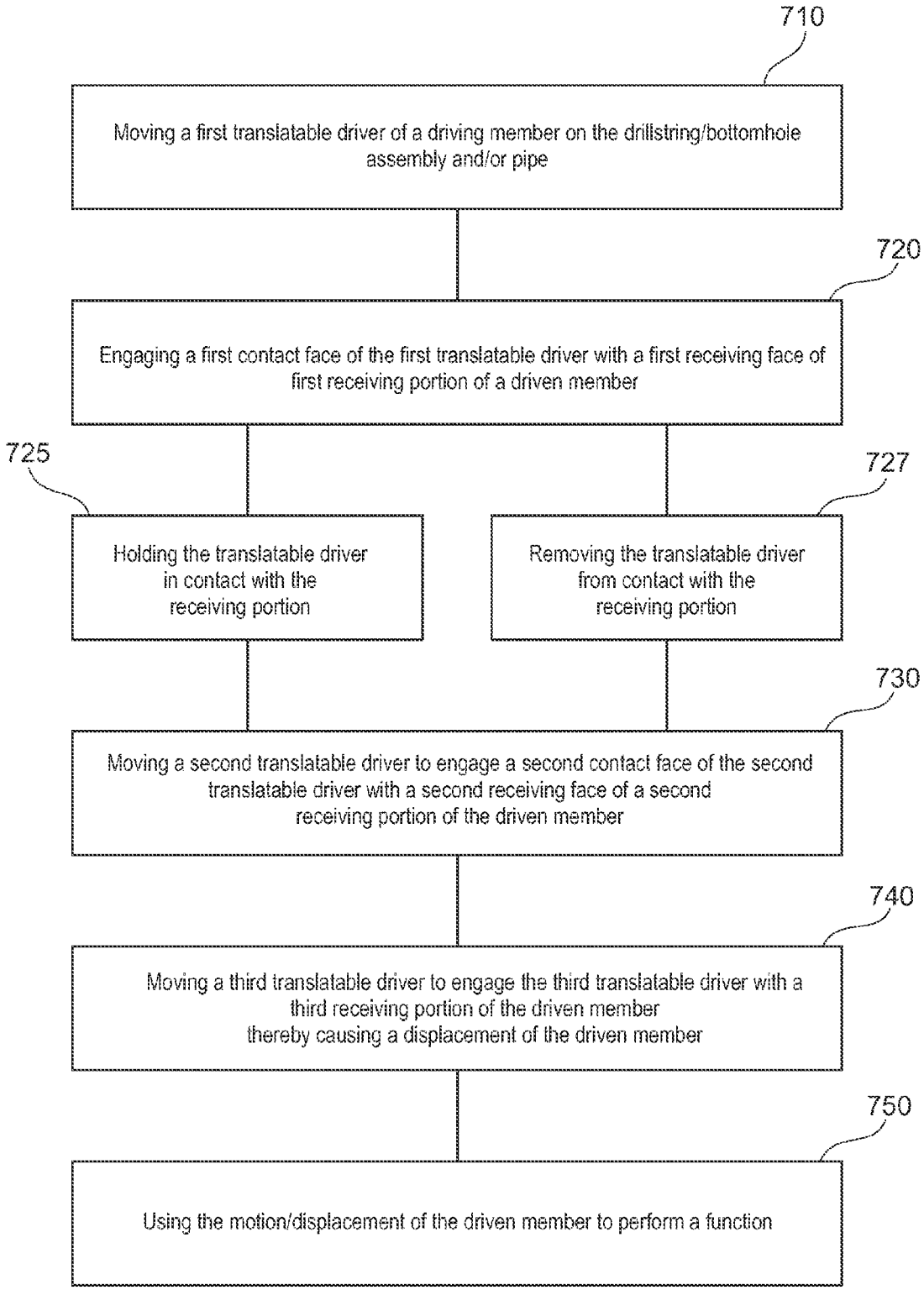
FIG. 7 is a flow-type illustration of a method of driving a mechanism on a drillstring or pipe, in accordance with an embodiment of the present invention.

FIG. 7 is a flow-type illustration of a method of driving a mechanism on a drillstring or pipe, in accordance with an embodiment of the present invention. In accordance with an embodiment of the present invention, a driving mechanism comprising a driving member and a driven member is coupled with the drillstring or pipe.

In step 710 a first translatable driver of the driving member is moved on the drillstring or pipe. The motion of the driving member may be in any direction on the drillstring/bottomhole assembly and/or pipe. In some embodiments of the present invention, the translatable driver is moved in a longitudinal direction or at least with a component of motion in a longitudinal direction on the drillstring/bottomhole assembly and/or pipe, where longitudinal motion comprises motion parallel with a center axis of the drillstring/bottomhole assembly and/or pipe. This type of movement of the translatable driver may be used, as discussed herein, to provide a rotational motion of the driven member. Moreover the use of the term "on the drillstring/bottomhole assembly and/or pipe" does not mean that the translatable driver is limited to being held "on" the drillstring/bottomhole assembly and/or pipe since in embodiments of the present invention, the translatable driver may be disposed within the drillstring/bottomhole assembly and/or pipe, on a device coupled with the drillstring/bottomhole assembly and/or pipe and/or the like. The use of the term "on the drillstring/bottomhole assembly and/or pipe" being used for descriptive purposes only.

As persons of skill in the art may appreciate, the motion of the translatable drivers only has to have a component along the direction of the drillstring, bottomhole assembly and/or pipe since a slanted arrangement of the drivers and/or the receiving portions around the drillstring, bottomhole assembly and/or pipe may also be used to produce a motion of the driven member around—clockwise or anticlockwise—the drillstring/bottomhole assembly and/or pipe. In other embodiments of the present invention, a motion of the translatable driver in a direction other than along the drillstring/bottomhole assembly and/or pipe may be used to drive the driven member in a motion/displacement other than around the drillstring/bottomhole assembly and/or pipe.

The driving member may comprise a plurality of the translatable drivers and may be arranged around the drillstring, bottomhole assembly and/or pipe. In some embodiments the arrangement may be circumferentially around the drillstring/bottomhole assembly and/or pipe so that the drive mechanism is disposed on the outside of the drillstring/bottomhole assembly and/or pipe. In other embodiments, the drive mechanism may be disposed within the drillstring/bottomhole assembly and/or pipe under a protective sleeve, layer or the like to protect the drive mechanism and/or on a framework/system coupled with the drillstring/bottomhole assembly and/or pipe.

In certain embodiments, the driving member may comprise a cylinder, a frame or the like that may hold the translatable drivers such that they may be moveable in a direction along the drillstring, bottomhole assembly and/or pipe. A motor may be used to provide the power to cause the movement of the translatable driver. The motor may comprise an electric motor, a hydraulic motor and/or the like. Moreover in aspects of the present invention a processor may be used to control the motor, the driving member, the translatable driver and/or the like In step 720 a first contact face of the translatable driver is engaged with a first receiving face of a receiving portion of the driven member. In aspects of the present invention, the translatable driver comprises at least one contact face that can be driven into contact with the driven member when the translatable driver is moved on the drillstring, bottomhole assembly and/or pipe. In some aspects of the present invention, the translatable driver may actually move along the drillstring, bottomhole assembly and/or pipe and in other aspects the translatable driver may be separate from the drillstring, bottomhole assembly and/or pipe and may move in a direction that is directed along the drillstring, bottomhole assembly and/or pipe.

The contact face may comprise an incline, parabola, cone, curve, combination of one or more of the foregoing and/or the like. In one aspect of the present invention, the translatable driver may comprise a V-shaped end and the contact face may comprise one of the faces of the "V". In another aspect of the present invention, the translatable driver may comprise a curved-shaped end, a cone shaped end, a parabolic shaped end and or the like and the contact face may comprise one of the faces of the shaped end of the translatable driver.

In an embodiment of the present invention, the driven member comprises a plurality of receiving portions where the receiving portions may comprise indents in the driven member or the like. Merely by way of example, the indents may comprise V-shaped indents in the driven member. In other aspects, the indents may comprise indents shape with curved sides, parabolic sides, cone shaped indents and/or the like. In an embodiment of the present invention, a side of the indent in the driven member may comprise a receiving face. In a method in accordance with an embodiment of the present invention, the contact face and the receiving face may be configured such that when the translatable driver is moved into contact with the driven member, the contact face and the receiving face slide over each other and generate a rotational motion/displacement of the driven member. The rotational motion may be clockwise or anticlockwise around the drillstring, bottomhole assembly and/or pipe.

In step 725, the translatable driver may be held in contact with the receiving portion. In this way, in an aspect of the present invention, the translatable driver may be used to lock the driven member into a certain position on the drillstring, bottomhole assembly and/or pipe and may also serve, in turn, to hold a device coupled with the driving mechanism in a locked position. In some embodiments, the driving mechanism may be at least partially isolated from motion of the drillstring, bottomhole assembly and/or pipe. In such embodiments, the driving mechanism may be held geostationary while the drillstring, bottomhole assembly and/or pipe may be rotated etc. In embodiments of the present invention, by locking the driven member, a device coupled with the driving mechanism may be held geostationary. Moreover, if the drillstring, bottomhole assembly and/or pipe is rotating, the driving mechanism may be isolated from this rotation to provide for moving a device without passing on the rotating motion of the drillstring, bottomhole assembly and/or pipe to the device.

In step 727, the translatable driver may be disengaged from contact with the receiving portion. This disengagement may occur prior to the following step 730, in combination with step 730 or the like depending on the desired motion of the driven member.

In step 730, a second translatable driver may be moved into engagement with the driven member. In certain aspects this engagement may be synchronized with the disengagement of step 727 so that there is continuous contact of the driving member and the driven member. In other aspects, the engagement and disengagement may be isolated procedures.

In an embodiment of the present invention, a second contact face of the second translatable driver may contact a second receiving face of a second receiving portion of the driven member. In an aspect of the present invention, the geometry/positions of the translatable drivers on the driving member and the geometry/positions of the receiving portions on the driven member may be selected so that displacement/motion of a sequence of the translatable drivers provides for successive engagement with receiving portions of the driven member. In some aspects, a processor or the like may control the operation of the translatable drivers so that a desired motion/displacement of the driven member is produced by the drivers.

As with the displacement/motion of the first translatable driver, the displacement/motion of the second translatable driver cause the second contact face of the driver to engage with the second receiving face of the second receiving portion, wherein the contact faces slide over one another producing a rotational motion/displacement of the driven member. In some aspects, the contact faces of the second translatable driver and the second receiving portion may have the same geometry as that of the first contact face and the first receiving face. In other aspects of the present invention, the contact faces of the second translatable driver and the second receiving portion may have a different geometry to that of the first contact face and the first receiving face.

In step 740, a third translatable driver is moved so as to engage with a third receiving portion of the driven member. In some aspects of the present invention, such as where the driver has a V-shaped functional end, the alternate contact faces on either side of the V-shaped functional end may produce opposite directions of motion/displacement of the driven member.

In some embodiments of the present invention, a device, such as an electric motor, a spring, a connection mechanism between the driving member and the driven member or the like may be used to provide a desired alignment between the driving member and the driven member.

In step 740, the motion/displacement of the driven member may be used to perform a function. The function may include but is not limited to changing a position of a valve, positioning a directional drilling component in the borehole, positioning a sensor and/or the like.

While the principles of the disclosure have been described above in connection with specific apparatuses and methods, it is to be clearly understood that this description is made only by way of example and not as limitation on the scope of the invention.

The invention claimed is:

1. A drive mechanism for use on a pipe or drillstring comprising:

a driving member configured in use to be disposed around the pipe or drillstring, the driving member comprising a plurality of drivers linearly translatable with respect to the driving member and in a longitudinal direction with respect to a center axis of the pipe or drillstring, each of the drivers having at their ends a male engaging portion; and an associated driven member configured in use to be disposed around the pipe or drillstring, the driven member comprising a plurality of female receiving portions each adapted to receive a one of the male engaging portions, wherein;

the male engaging portion comprises a v-shape projection comprising a first and a second inclined engaging surface, the first and the second inclined engaging surfaces meeting to form a tip of the v-shape projection;

the female receiving portion comprises a v-shape indentation comprising a first and a second inclined receiving surface, the first and the second inclined receiving surfaces meeting to form a bottom of the v-shape indentation;

in use the plurality of drivers and the driven member are configured such that a linear translation of a first of the plurality of drivers causes the male engaging portion of the first of the plurality of drivers to engage with a first of the female receiving portions and the engagement of the male engaging portion of the first of the plurality of drivers with the first of the female receiving portions causes a reaction in the first of the female receiving portions producing a displacement of the driven member in a direction other than that of the translatable driver;

the displacement of the driven member causes the driving member and the driven member to be configured such that a second of the plurality of drivers is positioned to be engagable with a second of the plurality of female receiving portions such that engagement of the second of the plurality of drivers with the second of the plurality of receiving portions causes a further displacement of the driven member; and wherein the linearly translatable drivers are elongate and arranged to be moveable in a direction parallel to their length, and wherein the plurality of drivers and the plurality of female receiving portions are configured such that engagement of the first of the inclined engaging surfaces with a first of the inclined receiving surfaces produces the displacement of the driven member in the direction and engagement of the second of the inclined engaging surfaces with a second of the inclined receiving surfaces produces the displacement of the driven member in a reverse direction.

2. A mechanism according to claim 1, wherein arrangement of the driving member and the driven member is such that when a first tip of the first of the plurality of drivers is positioned over or in contact with a first bottom of the first of the of the female receiving portions a second tip of the second of the plurality of drivers is not positioned over nor in contact with a second bottom of the second of the of the female receiving portions such that engagement of the second of the plurality of drivers and the second of the receiving portions produces a movement of the driven member.

3. A mechanism according to claim 1, wherein the displacement is in a direction substantially perpendicular to that of the movement of the drivers.

4. A mechanism according to claim 1, wherein the driving member comprises a series of evenly spaced drivers and the driven member comprises a series of evenly spaced receiving portions.

5. A mechanism according to claim 4, wherein the spacing between the drivers is different to the spacing between the receiving portions.

6. A mechanism according to claim 5, wherein the driven member has cylindrical geometry with the receiving portions facing axially to receive drivers translatable in an axial direction.

7. A mechanism according to claim 6, wherein the entire mechanism takes the form of an annular cylinder.

8. A mechanism according to claim 7, which has a length of less than 500 mm, a diameter of less than 200 mm and an annular space of at least 20 mm in diameter.

9. A mechanism according to claim 4, wherein the spacing between the drivers is greater than the spacing between the receiving portions.

10. A mechanism according to claim 1, wherein the receiving portions are positioned along a circular region of the driven member.

11. A mechanism according to claim 1, wherein the drive mechanism is coupled with a bottomhole assembly.

12. A mechanism according to claim 11, wherein the drive mechanism is coupled with a directional drilling mechanism.

13. A mechanism according to claim 12, wherein the directional drilling mechanism is an angled component of the drillstring.

14. A mechanism according to claim 11, wherein the driving mechanism is disposed between a downhole motor and a drill bit.

15. A mechanism according claim 11, wherein the drillstring is capable of directional drilling.

16. A mechanism according to claim 1, wherein the drillstring comprises coiled tubing.

17. A mechanism according to claim 1, wherein the pipe comprises a conduit for transporting hydrocarbons.

18. A drive mechanism for use on a drillstring, comprising:

a cylindrical drive member configured for coupling with the drillstring, the cylindrical drive member comprising a plurality of drivers, wherein each of the plurality of drivers comprises a first contact face and a second contact face and wherein each of the plurality of drivers is configured to be translatable in a longitudinal direction with respect to a center axis of the cylindrical driving member;

a cylindrical driven member configured for coupling with the drillstring, the cylindrical driven member comprising a plurality of receiving portions, wherein each of the plurality of receiving portions comprise a first receiving face and a second receiving face and the first receiving face is configured to engage with and slide over the first contact face of a one of the plurality of drivers and cause a clockwise rotation of the driven member and the second receiving face is configured to engage with and slide over the second contact face of the one of the plurality of drivers and cause an anticlockwise rotation of the driven member, and wherein the first contact face of the driver comprises a surface inclined with respect to the direction of movement of the driver and the second receiving face comprises a corresponding inclined surface such that the two surfaces contact each other upon engagement; and a power source for powering longitudinal translation of the plurality of drivers.

19. A drive mechanism according to claim 18, wherein the plurality of drivers comprise v-shaped functional ends, and wherein the plurality of receiving portions comprise v-shaped indents in the driven member.

20. A drive mechanism according to claim 18, wherein the power source comprises an electric motor.

21. A drive mechanism according to claim 18, wherein the power source comprises a hydraulic motor.

22. A drive mechanism according to claim 21, wherein the hydraulic motor is powered at least in part by drilling fluid.

23. A drive mechanism according to claim 18, wherein the drive mechanism is configured to be coupled with a bottomhole assembly.

24. A drive mechanism according to claim 18, wherein the drillstring comprises coiled tubing.

25. A drive mechanism according to claim 18, wherein the drive mechanism is configured to be coupled with the drillstring between a downhole motor and a drill bit.

* * * * *